US007210233B2

(12) United States Patent
Costain

(10) Patent No.: US 7,210,233 B2
(45) Date of Patent: May 1, 2007

(54) CUE STICK TIP-SHAPER ASSEMBLY

(75) Inventor: Paul Costain, Beverly, MA (US)

(73) Assignee: Clawson Custom Cues, Inc., Jacksonville, FL (US)

( * ) Notice: Subject to any disclaimer, the term of this patent is extended or adjusted under 35 U.S.C. 154(b) by 0 days.

(21) Appl. No.: 10/697,416

(22) Filed: Oct. 30, 2003

(65) Prior Publication Data

US 2005/0091858 A1 May 5, 2005

(51) Int. Cl.
*A63D 15/00* (2006.01)
*B27L 9/00* (2006.01)

(52) U.S. Cl. ..... 30/494; 473/35; 473/36; 473/39; 7/158; 7/163

(58) Field of Classification Search ..... 30/494; 451/344, 346, 552, 540, 526, 314, 180, 181, 451/132, 319; 473/1, 44, 70, 35–39; 81/451; 7/158, 163, 124, 160; 144/28.11, 28.2, 30; D22/782

See application file for complete search history.

(56) References Cited

U.S. PATENT DOCUMENTS

| | | | | | |
|---|---|---|---|---|---|
| 89,624 | A * | 5/1869 | Boyle | 30/494 |
| 94,317 | A * | 8/1869 | Collender | 30/494 |
| 222,035 | A * | 11/1879 | Gottlieb | 30/494 |
| 509,599 | A * | 11/1893 | Higgs | 30/494 |
| 538,119 | A * | 4/1895 | Olney | 30/494 |
| 790,143 | A * | 5/1905 | Low | 30/494 |
| 1,079,687 | A * | 11/1913 | Balzano | 30/494 |
| 1,080,209 | A * | 12/1913 | Garon | 30/494 |
| 1,159,891 | A * | 11/1915 | Bohlig | 30/494 |
| 1,279,734 | A * | 9/1918 | McCarthy | 30/494 |
| 1,534,975 | A * | 4/1925 | Lindfors | 30/494 |
| 2,577,995 | A * | 12/1951 | Bozarth | 30/494 |
| 3,728,828 | A * | 4/1973 | Freedman | 451/540 |
| 4,594,782 | A * | 6/1986 | Willard | 30/494 |
| 4,620,370 | A * | 11/1986 | Zownir et al. | 30/494 |
| 4,785,586 | A * | 11/1988 | Kratfel | 451/552 |
| 4,827,618 | A | 5/1989 | Lynn | |
| 5,129,187 | A * | 7/1992 | Cain | 451/28 |
| 5,228,160 | A * | 7/1993 | Porper | 7/158 |
| 5,551,111 | A * | 9/1996 | Murphy | 7/138 |
| 5,887,350 | A | 3/1999 | Porper | |
| 6,905,417 | B1 * | 6/2005 | Tona et al. | 473/36 |
| 2001/0029635 | A1 * | 10/2001 | Method | 7/164 |
| 2002/0010031 | A1 * | 1/2002 | Pettigrew | 473/1 |

* cited by examiner

*Primary Examiner*—Boyer D. Ashley
*Assistant Examiner*—Ghassem Alie
(74) *Attorney, Agent, or Firm*—Hamilton, Brook, Smith & Reynolds, P.C.

(57) ABSTRACT

A cue tip shaper for shaping and reshaping a shapeable cue tip on a cue stick utilized for playing pool or billiards. The cue tip shaper comprises a planar base, and an arrangement of articulable guides for receiving and aligning a cue stick tip with a tip shaping scuff member. The cue stick is received between the guides and pressable against the scuff member. The tip is typically leather. A scuff surface is arranged on the scuff member secured in the planar base, and is in alignment with the movable guides.

9 Claims, 2 Drawing Sheets

CUE STICK TIP-SHAPER ASSEMBLY

BACKGROUND OF THE INVENTION

1. Field of the Invention

The present invention relates to an apparatus for trimming and shaping and scuffing the tips of the billiard and pool sticks.

2. Prior Art

Billiards is an indoor game played on a rectangular table covered with felt. Players drive plastic balls against one another with a wooden stick called a cue. The cue has a leather tip which strikes the plastic balls. Billiards may refer to two different games, one including billiards which is often called pool, and the billiards game itself. In a game of pool, a white cue ball is used to drive a number of colored object balls, usually fifteen, into pockets at the edge of the table. In billiards, only three balls are used, two object balls being hit by one cue ball. The primary equipment for this game is a cue, which is typically made of a high-quality ash or maple wood, and may range up to about 57 inches in length. Such a cue or stick, has a tip, typically made of leather. The tip may be of hemispherical configuration. Striking the ball and hitting it to move in the desired direction is the critical requirement of these games. Slippage or sliding of the ball relative to the cue tip will certainly affect the path of the ball. Chalk is typically rubbed on the cue tip to prevent the cue from slipping off of the ball and spoiling a shot. During use, the cue tip may become worn or mis-figured. Sophisticated players will reshape the cue tip during a game to ensure the accuracy of their striking of the tip against a ball.

A variety of devices have been devised for shaping of the tip of a cue stick. One such device is shown in U.S. Pat. No. 5,228,160 to Porper. The device disclosed in Porper is a cue tip shaping tool comprising a multi purpose tip preparer with a number of manipulable attachments therewith, which altogether, is rather complicated.

A further cue tip shaper is shown in U.S. Pat. No. 5,129,187 to Cain. This device comprises an elongated housing which is further complicated by a chalk applicator therewith. U.S. Pat. No. 4,827,618 to Lynn shows a generally cylindrically shaped cue tip shaper having the ability to receive a different cue stick at each end of the housing. This shaper also however, requires the use of a curved blade within its housing. Blades have to be replaced after they've been used several times, adding to the disadvantage of possible misalignment.

A similar condition exists in U.S. Pat. No. 5,887,350 to Porper, showing a trimming and shaping tool, which also utilizes a blade. This apparatus as well, requires the changing of a blade after several uses, adding to its complicated nature.

These exemplary prior art devices are somewhat complicated, and fail to have the ability to adapt themselves properly to any variation in cue stick tip diameter.

It is an object of the present invention to overcome the disadvantages of the prior art.

It is yet a further object of the present invention to provide a cue tip shaper apparatus which will accommodate a multiplicity of cue stick tip diameters.

It is a further object of the present invention to provide a cue stick tip shaper which will improve the accuracy of the cue and make the tip readily consistent.

It is a further object of the present invention to provide a cue stick tip shaper which will improve the consistency of the ball striking and will minimize the necessity of changing tips as often as the prior art.

It is a further object of the present invention to provide a tip shaper which will keep the cue sticks in proper alignment during the shaping operation and shape those tips properly relative to the cue stick.

It is a further object of the present invention to provide a cue stick tip shaper which is usable on all shaft sizes, for example 10 mm to 14 mm. It is still yet a further object of the present invention to provide a cue stick tip shaper which will generate less heat during the shaping and scuffing operation, thus minimizing the de-layering of laminated tips.

BRIEF SUMMARY OF THE INVENTION

The present invention comprises a cue stick tip-shaper assembly for shaping a multiplicity of different diameter cue stick tips in a concentric and consistent manner. The tip-shaper assembly comprises a generally square base plate having a first corner, the base plate having a second corner diagonally thereacross. A generally hemispherically-shaped cutout or depression is arranged on an upper surface of the base plate, between the first and second corners at the center of the base plate. An elongated slot is arranged adjacent the first corner and adjacent the periphery of the hemispherically shaped cutout thereat. A second elongated slot is arranged at the second corner of the base plate. The second elongated slot is arranged between the periphery of the hemispherically-shaped cutout and the second corner.

The tip-shaper assembly comprises a generally rectilinearly-shaped first guide and a generally rectilinearly shaped second guide. The first guide and the second guide have outermost wall surfaces which are in peripheral alignment within the periphery of the planar base plate. The first guide has a lowermost surface which is in sliding contact with the upper surface of the planar base plate. The first guide has a first corner with a tapped hole therein. The tapped hole is in alignment with the first elongated slot in the first corner of the planar base plate. The second guide is correspondingly arranged, with a lowermost planar surface in rubbing and abutted contact with the upper surface of the planar base plate. The second guide has a second corner with a tapped hole through its lowermost surface, the tapped hole being in longitudinal alignment with the elongated slot in the second corner of the planar base plate. A shoulder screw is slidingly arranged through the first elongated slot and into threaded engagement with the tapped hole at the first corner of the first guide. A second shoulder screw is slidingly arranged through the second elongated slot in the second corner of the planar base plate, and is in threaded engagement with the tapped hole in the second corner in the second guide.

The shoulder screw engaged in the elongated slots with the respective first and second guides permits their articulation independent of one another and movement relative to the base.

The first guide has a frontal face which touches and slides against a frontal face of the second guide. A V-shaped groove is arranged along the frontal face of the first guide and a corresponding V-shaped groove is arranged along the frontal face of the second guide. The V-shaped groove in the first guide and the V-shaped groove in the second guide defines a variably adjustable opening for receipt of the distal end of a cue stick. The opening defined by the two V-shaped grooves is in central alignment with the hemispherically-shaped cutout on the upper surface of the planar base plate. The hemispherically-shaped cutout has a scuffed surface thereon. The scuffed surface may be comprised of a grit-like material or a hemispherically-shaped insert with the scuffed surface thereon, and adhereingly placed within the cutout.

Such a scuff surface may be characterized as somewhat similar to a cheese grater or a rasp file.

A cue stick inserted within the proposed V-shaped grooves in the first guide and the second guide is kept in longitudinal alignment with the hemispherically-shaped scuff surface in the base plate.

The first guide and the second guide are preferably made of a lubricious material, such as Teflon®, UHMW (ultra-high molecular weight) plastic or the like. A cue stick with a leather tip thereon, is inserted between the articulable first guide and the articulable second guide, so that the walls of the V-shaped grooves are in rubbing contact therewith. The guides and hence the V-shaped grooves may be moved relative to one another to alignably engage any diameter cue stick registering therebetween. Rotation of the cue stick about its longitudinal axis and pressuring of the tip thereon against the scuff surface in the hemispherically-shaped cut-out in the planar base will concentrically contour that tip of that cue stick. Sliding movement of the shoulder screw within the respective elongated slots in the first and second corner of the planar base and the rotation of each respective guide about their shoulder screws permits a wide range of accommodation of a particular cue stick to the scuff surface in the base plate.

The invention thus comprises a cue tip shaper for shaping and reshaping a cue tip on a cue stick used for playing pool or billiards, comprising: a planar base; an arrangement of articulable guides for receiving and aligning a cue stick tip received therebetween; and a scuff surface arranged on the planar base in alignment with the guides. Each of the guides may have a groove thereon to define a channel for receipt of the cue stick. Each of the guides may be movably attached to the base. The base may have an arrangement of elongated slots thereon for receipt of a shoulder screw for movable securement of the guides thereto.

Each groove may comprise a "V" shaped notch arranged on a front face of each of the guides. Each guide may be movable with respect to one another to provide an adjustable opening for a cue stick therebetween. Each of the guides may be movable with respect to the base. The scuff surface may comprise a generally hemispherically shaped cutout arranged on an upper surface of the base. The scuff surface may comprise a replaceable insert of grit material or a rasp surface.

The invention may also comprise a method of shaping a tip of a cue stick comprising the steps of: arranging a pair of articulable guides adjacent a scuff surface; inserting a tip of a cue stick between the guides so as to guide the distal end of the cue stick tip towards the scuff surface in the base of the device; moving the guides with respect to one another to permit the guide to accommodate any diameter cue stick tip; and rotating the cue stick about its longitudinal axis while rubbing its tip against the scuff surface so as to shape said tip.

The steps may also include: forming an arrangement of grooves in the guides to define an elongated opening therebetween, so as to support the cue stick in alignment with the scuff surface; varying the size of the elongated opening to permit supported guidance of a cue stick tip therewith. The grooves are preferably of "V" shape in cross-section. The scuff surface is preferably comprised a generally hemispherically shaped depression. The surface may be comprised of a replaceable insert for insertion into the depression.

BRIEF DESCRIPTION OF THE DRAWINGS

The objects and advantages of the present invention will become more apparent when viewed in conjunction with the following drawings in which.

DESCRIPTION OF THE PREFERRED EMBODIMENTS

Figure 1:
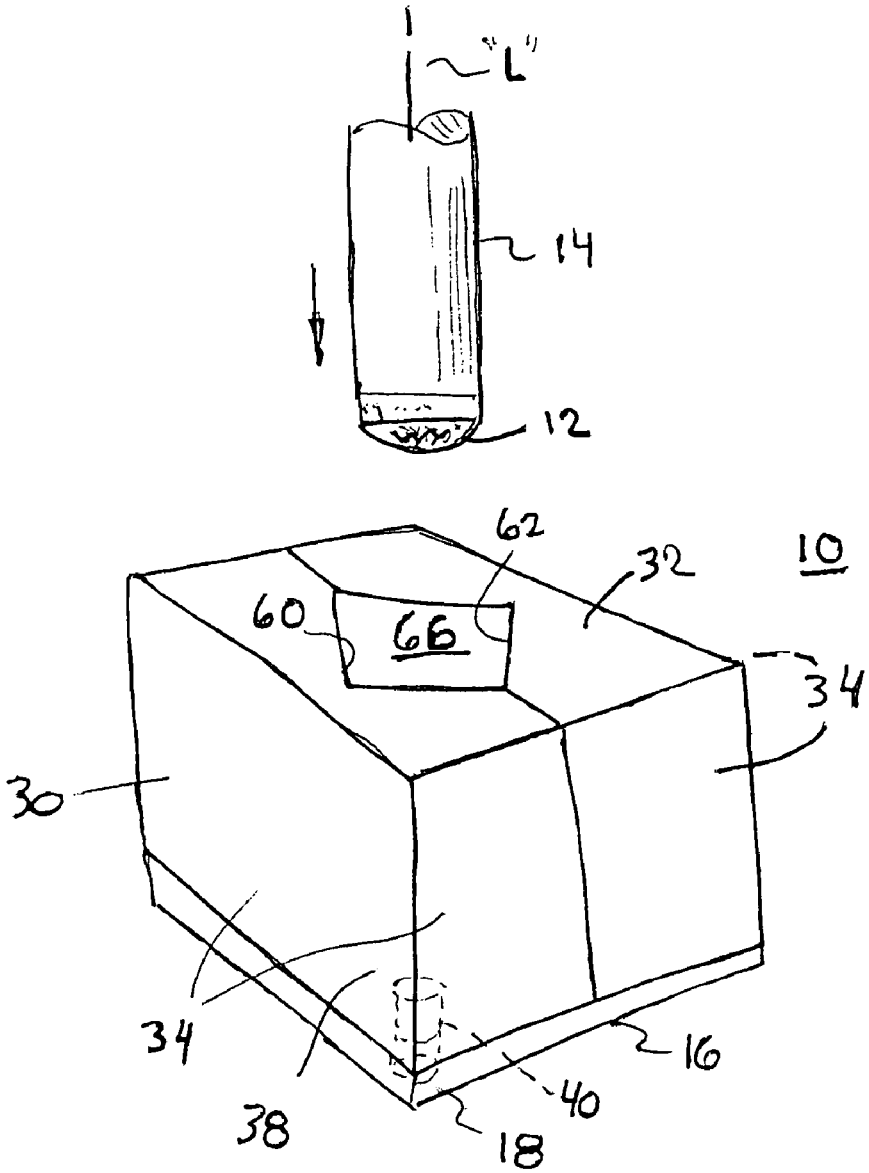
FIG. 1 is a perspective view of a cue stick tip shaper assembly showing a distal potion of a cue stick in alignment therewith.
Figure 4:
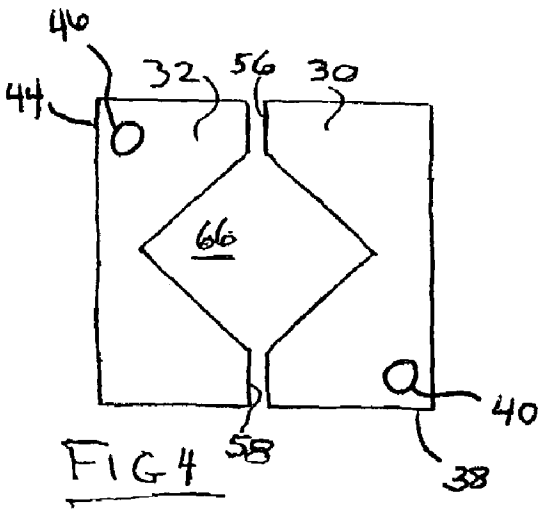
FIG. 4 is a bottom view of the first and second guides of the cue tip shaper assembly.

Referring now to the drawings in detail, and particularly to FIG. 1 there is shown the present invention comprises a cue stick leather-tip-shaper assembly 10 for shaping any one of a multiplicity of different diameter cue stick tips 12 of any cue stick 14, in a concentric and consistent manner. The tip-shaper assembly 10 comprises a generally square base plate 16 having a first corner 18, the base plate 16 having a second corner 20 diagonally thereacross, as shown more clearly in FIGS. 2 and 3.

Figure 3:
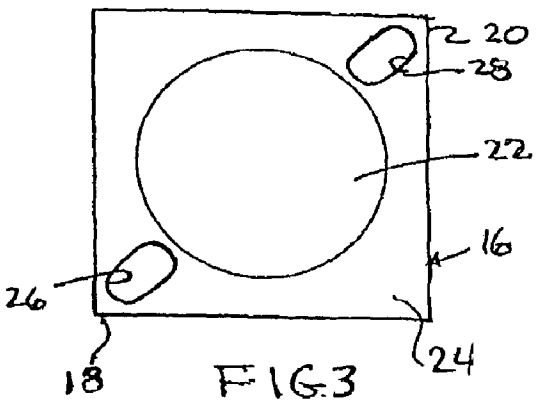
FIG. 3 is a plan view of the planar base of the cue stick shaper assembly.

A generally hemispherically-shaped cutout or depression 22 is arranged on an upper surface 24 of the base plate 16, between the first and second corners 18 and 20 at the center of the base plate 16. An elongated first slot 26 is arranged adjacent the first corner 18 and adjacent the periphery of the hemispherically shaped cutout 22 thereat. An elongated second slot 28 is arranged at the second corner 20 of the base plate 16. The elongated second slot 28 is arranged between the periphery of the hemispherically-shaped cutout 22 and the second corner 20, as best represented in FIG. 3.

Figure 5:
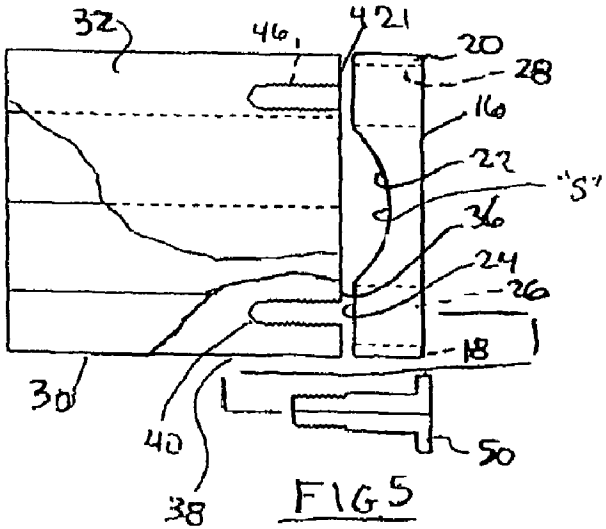
FIG. 5 is a side elevational view partly in section, of the cue tip shaper assembly shown in FIG. 1.
Figure 2:
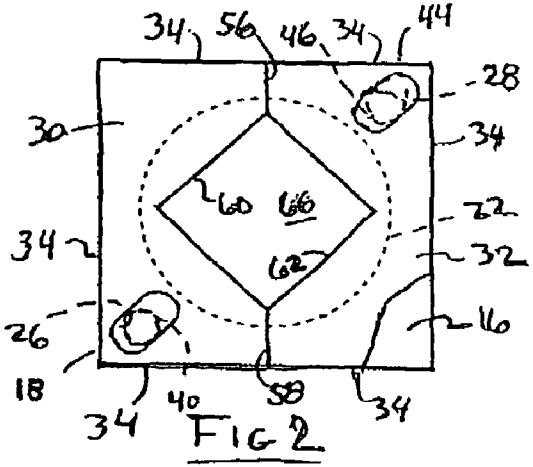
FIG. 2 is a plan view of the cue stick tip shaper assembly shown in FIG. 1.

The tip-shaper assembly 10 also includes a generally rectilinearly-shaped first guide 30 and a generally rectilinearly shaped second guide 32, as represented in figures 1, 2, 4 and 5, the guides 30 and 32 being arranged to be movable with respect to one another and the base plate 16. The first guide 30 and the second guide 32 each have outermost wall surfaces 34 which are in peripheral alignment within the periphery of the planar base plate 16. The first guide 30 has a lowermost surface 36 which is in sliding contact with the upper surface 24 of the planar base plate 16. The first guide 30 has a first corner 38 with a first tapped hole 40 therein. The first tapped hole 40 is in alignment with the elongated first slot 26 in the first corner 18 of the planar base plate 16. The second guide 32 is correspondingly arranged, with a lowermost planar surface 42 in rubbing and abutted contact with the upper surface 24 of the planar base plate 16. The second guide 32 has a second corner 44 with a tapped hole 46 as shown in FIG. 5, through its lowermost surface 42, the tapped hole 46 being in longitudinal alignment with the elongated slot 28 in the second corner 20 of the planar base plate 16, as represented in FIG. 2.

A shoulder screw 50 is slidingly arranged through the first elongated slot 26 and into threaded engagement with the tapped hole 40 at the first corner 38 of the first guide 30. A second shoulder screw (not shown for clarity) is slidingly arranged through the second elongated slot 28 in the second corner 20 of the planar base plate 16, and is in threaded engagement with that tapped hole 46 in the second corner 44 in the second guide 32.

The shoulder screw(s) 50 engaged in the elongated slots 26 and 28 with the respective first and second guides 30 and 32 permits their connected articulation independent of one another and movement relative to the base plate 16.

The first guide 30 has a frontal face 56 which faces a frontal face 58 of the second guide 32. A V-shaped groove 60 is arranged along the frontal face 56 of the first guide 30 and a corresponding V-shaped groove 62 is arranged along the frontal face 58 of the second guide 32, as may be seen in FIGS. 1, 2, 4 and 5.

The V-shaped groove 60 in the first guide and the V-shaped groove 62 in the second guide 32 define a variably adjustable opening 66 for receipt of the distal end of a cue stick 14. The opening 66 defined by the two V-shaped grooves 60 and 62 is in central alignment with the hemispherically-shaped cutout 22 on the upper surface 24 of the planar base plate 16 as represented in FIGS. 2 and 5. The hemispherically-shaped cutout 22 has a scuffed surface "S" thereon. The scuffed surface "S" may be comprised of a grit-like material or it may in a further embodiment, be a hemispherically-shaped insert with the scuffed surface thereon, and adhereingly placed within the cutout 22.

A cue stick 14 inserted into the opening 66 defined by the opposed V-shaped grooves 60 and 62 in the first guide 30 and the second guide 32 is kept in longitudinal alignment with the hemispherically-shaped scuff surface "S" in the base plate 16.

The first guide 30 and the second guide 32 are preferably made of a lubricious material, such as Teflon®, UHMW plastic or the like. A cue stick 14 with a leather tip 12 thereon, is inserted between the articulable first guide and the articulable second guide, so that the walls of the V-shaped grooves 60 and 62 are in minimal friction rubbing contact therewith. The guides 30 and 32 and hence the V-shaped grooves 60 and 62 may be moved relative to one another to alignably engage any diameter cue stick 14 registering into the opening 66 therebetween. Rotation of the cue stick 14 about its longitudinal axis "L" and pressuring of the tip 12 thereon against the scuff surface "S" in the hemispherically-shaped cutout 22 in the planar base 16 will concentrically contour that tip 12 of that cue stick 14. Sliding movement of the shoulder screw 50 within their respective elongated slots 26 and 28 in the respective first and second corners 18 and 20 of the planar base 16 and the limited arcuate rotation and movement of each respective guide 30 and 32 about their shoulder screws 50 permits a wide range of accommodation of a particular cue stick 14 to the scuff surface "S" in the base plate 16.

Thus what has been shown is a unique que stick tip shaper which automatically provides concentricity to the tip when the shaper is being utilized. The shaper of the present invention also provides "runout" which may be defined as composite tolerance used to control functional relationships of one or more features of a part, to a datum axis. The datum axis here is the wooden shaft of the que stick, in relation to its length. The present invention also insures perpendicularity of the shaft to the scuff surface by virtue of its floating nature of the guides relative to the base. The present invention also holds the "true position" of the shaft by virtue of the adaptability of the shaper to sizes of the shaft. True position may be defined as a zone within which the central axis of the shaft, or the central plane of a feature size is not permitted to vary from a true theoretically exact position.

The invention claimed is:

1. A cue stick tip shaper for shaping and reshaping a cue tip on a cue stick used for playing pool or billiards, comprising:

a base;

an arrangement of articulable guides for receiving and aligning a cue stick tip received therebetween, each guide independently slides in a plane that is parallel to a surface of the base; and a scuff surface arranged on the base adjacent the surface of the base and in alignment with the guides for shaping a playing surface of said cue tip, the scuff surface having a generally hemispheric shape, the base, the guides and the scuff surface cooperating to maintain a cue stick in longitudinal alignment with the scuff surface on the base the rotation of the cue stick about its longitudinal axis and pressuring of the thereon against the scuff surface providing a generally hemispheric contour to cue tip that is substantially concentric with the longitudinal axis of the cue stick.

2. The cue tip shaper as recited in claim 1, wherein each of said guides has a groove thereon to define a channel for receipt of only a portion of said cue stick.

3. The cue tip shaper as recited in claim 1, wherein each of said guides includes a lubricious material.

4. The cue stick rip shaper as recited in claim 3, wherein said base has an arrangement of elongated slots thereon for receipt of a shoulder screw for movable securement of said guides to said base.

5. The cue stick tip shaper as recited in claim 2, wherein said groove comprises a "V" shaped notch arranged on a front face of each of said guides.

6. The cue stick tip shaper as recited in claim 1, wherein each of said guides is slidable with respect to one another to provide an adjustable opening for a cue stick disposed therebetween.

7. The cue stick tip shaper as recited in claim 1, wherein each of said guides is connected to said base.

8. The cue stick tip shaper as recited in claim 1, wherein said scuff surface comprises a generally hemispherically shaped cutout arranged on an upper surface of said base.

9. The cue stick tip shaper as recited in claim 8, wherein said scuff surface comprises a replaceable insert of grit material.

* * * * *